US011222559B2

(12) United States Patent
Chykeyuk et al.

(10) Patent No.: US 11,222,559 B2
(45) Date of Patent: Jan. 11, 2022

(54) PERSISTENCE OF VISION (POV) DISPLAY PANELS AND SYSTEMS

(71) Applicant: KINO-MO LTD., London (GB)

(72) Inventors: Kiryl Chykeyuk, London (GB); Artsiom Stavenka, London (GB); Dzmitry Malinouski, London (GB)

(73) Assignee: Kino-mo Ltd.

( * ) Notice: Subject to any disclaimer, the term of this patent is extended or adjusted under 35 U.S.C. 154(b) by 0 days.

(21) Appl. No.: 17/048,536

(22) PCT Filed: May 17, 2018

(86) PCT No.: PCT/GB2018/051341
§ 371 (c)(1),
(2) Date: Oct. 16, 2020

(87) PCT Pub. No.: WO2019/207268
PCT Pub. Date: Oct. 31, 2019

(65) Prior Publication Data

US 2021/0097906 A1 Apr. 1, 2021

(30) Foreign Application Priority Data

Apr. 24, 2018 (GB) ..... 1806675

(51) Int. Cl.
*G09G 3/00* (2006.01)

(52) U.S. Cl.
CPC ..... *G09G 3/003* (2013.01); *G09G 3/005* (2013.01); *G09G 2300/026* (2013.01); *G09G 2360/04* (2013.01)

(58) Field of Classification Search
CPC combination set(s) only.
See application file for complete search history.

(56) References Cited

U.S. PATENT DOCUMENTS

2010/0020107 A1* 1/2010 Chui ..... G09G 5/02 345/690
2011/0164070 A1 7/2011 Sirmon et al.
2013/0215000 A1 8/2013 Dyer et al.

FOREIGN PATENT DOCUMENTS

KR 20110082349 A 7/2011

* cited by examiner

*Primary Examiner* — Charles V Hicks
(74) *Attorney, Agent, or Firm* — Thorpe North & Western, LLP.

(57) ABSTRACT

A persistence of vision (PoV) display panel (155) comprises first, second, third, fourth and fifth PoV display units (100) having first, second, third, fourth and fifth display areas (140) respectively. The first, second, third and fourth PoV display units (100) are arranged such that their respective display areas (140) form a 2×2 array in at least one display plane and form a display area void (150) bounded by their respective display areas. The fifth PoV display unit (100) is arranged such that the fifth display area (140) is offset from the at least one display plane and corresponds to the display area void (150).

18 Claims, 11 Drawing Sheets

155

155

155

PERSISTENCE OF VISION (POV) DISPLAY PANELS AND SYSTEMS

TECHNICAL FIELD

The present invention relates to persistence of vision (PoV) display panels and PoV display systems.

BACKGROUND

PoV is a phenomenon whereby a succession of images is perceived by the brain as forming a moving image.

A PoV display unit produces a PoV effect in a display area of a given size.

To produce a PoV effect in a larger display area, a larger PoV display unit may be used. However, with larger PoV display units comes practical considerations such as stability, safety, etc.

Instead of increasing the size of a PoV display unit to produce a PoV effect in a larger display area, a set of multiple PoV display units may be used such that the overall display area provided by the set of PoV display units increases, compared to the display area of a single PoV display unit. A set of multiple such PoV display units may be safer, more stable, etc. than a larger PoV display unit.

However, there are still practical considerations around using sets of multiple PoV display units. Such practical considerations include, but are not limited to, ease of installation, visual effectiveness, risk of damage to PoV display units through collisions, mechanical complexity, mechanical stability etc.

SUMMARY

According to a first aspect of the present invention, there is provided a persistence of vision, PoV, display panel comprising first, second, third, fourth and fifth PoV display units having first, second, third, fourth and fifth display areas respectively, wherein the first, second, third and fourth PoV display units are arranged such that their respective display areas form a 2×2 array in at least one display plane and form a display area void bounded by their respective display areas, and wherein the fifth PoV display unit is arranged such that the fifth display area is offset from the at least one display plane and corresponds to the display area void.

According to a second aspect of the present invention, there is provided a PoV display system comprising a PoV display panel provided in accordance with the first aspect of the present invention.

Further features and advantages of the invention will become apparent from the following description of preferred embodiments of the invention, given by way of example only, which is made with reference to the accompanying drawings.

DETAILED DESCRIPTION

Figure 1:
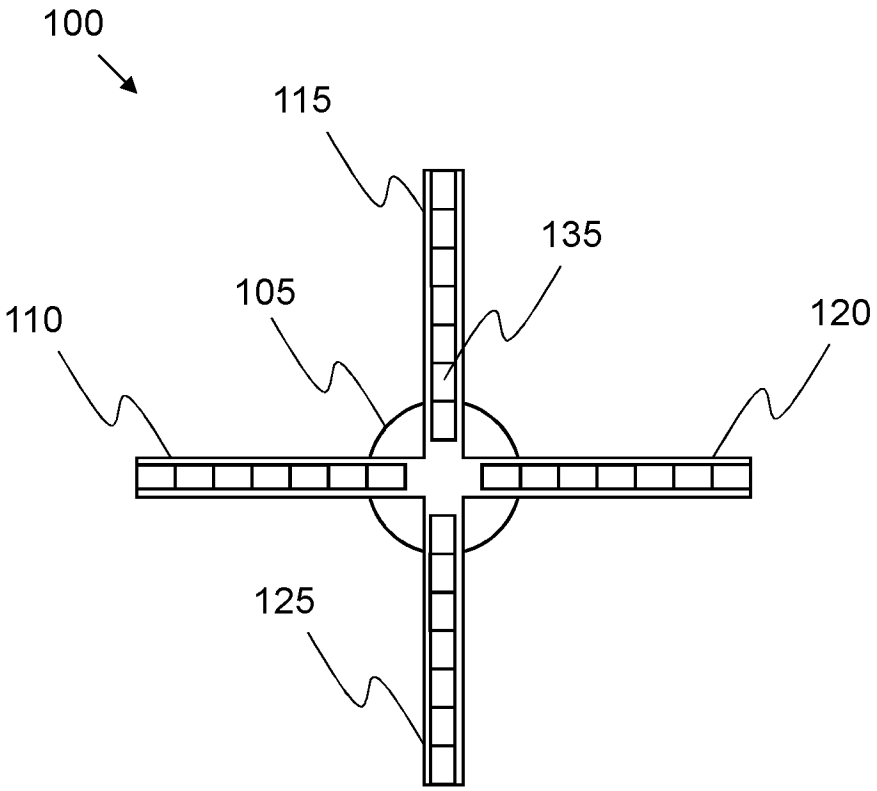
FIG. 1 shows a schematic representation an example of a PoV display device from the front of the PoV display device.
Figure 2:
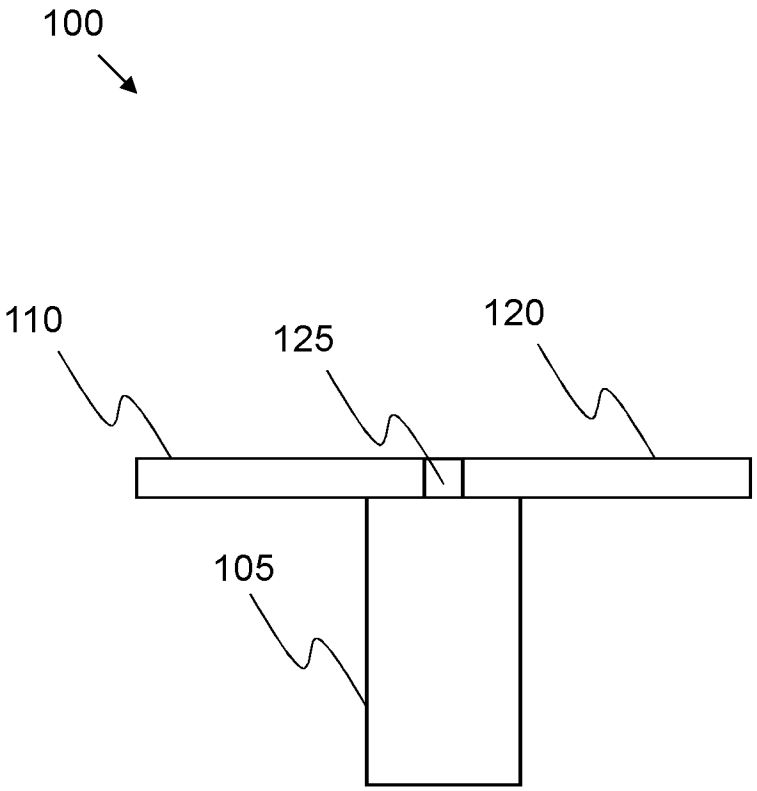
FIG. 2 shows a schematic representation of the example PoV display device shown in FIG. 1 from underneath the PoV display device.

Referring to FIGS. 1 and 2, there are shown schematically front and underneath views respectively of an example PoV display unit 100.

In this example, the PoV display unit 100 comprises a main body 105. The main body 105 houses one or more components of the PoV display unit 100. An example of such a component is a motor.

In this example, the PoV display unit 100 comprises four arms 110, 115, 120, 125. However, the PoV display unit 100 may comprise a different number of arms in other examples.

In this example, the four arms 110, 115, 120, 125 are arranged in the same plane as each other in a cross-formation. A cross-formation provides symmetry and balance to the display unit 100, which may facilitate operation of the PoV display unit 100 in practice. However, the PoV display unit 100 may comprise one or more arms arranged in a different manner. For example, the PoV display unit 100 may comprise two arms, for example corresponding to arms 110 and 120 only.

In this example, each arm 110, 115, 120, 125 comprises a plurality of light-emitting elements 135. In this specific example, each arm 110, 115, 120, 125 is shown, for illustrative purposes, as comprising seven light-emitting elements 135. However, the arms 110, 115, 120, 125 may comprise a different number of light-emitting elements 135 in other examples. For example, the PoV display unit 100 may, in practice, comprise many hundreds of light-emitting elements 135 to provide a desired resolution and an effective PoV effect.

In this example, the seven light-emitting elements 135 are arranged linearly on each arm 110, 115, 120, 125. However, the light-emitting elements 135 may be arranged in a different manner. For example, the light-emitting elements 135 may be arrange in multiple lines on each arm 110, 115, 120, 125. The light-emitting elements 135 may be arranged non-linearly in other examples.

The light-emitting elements 135 may comprise light-emitting diodes (LEDs).

The arrangement and/or nature of light-emitting elements 135 may be selected to provide a target resolution and/or colour representation capability for the PoV display unit 100.

In this example, the light-emitting elements 135 extend to the outer extremity of each of the arms 110, 115, 120, 125. This may enable a PoV effect to be provided up to the outer extremity of the arms 110, 115, 120, 125. However, in other examples, the light-emitting elements 135 may extend to a point inward of the outer extremity of each of the arms 110, 115, 120, 125.

In this example, the light-emitting elements 135 do not extend into the centre of the PoV display unit 100. As such, there is a "hole" resulting from the lack of presence of the light-emitting elements 135 in the centre of the PoV display unit 100. However, in other examples, one or more light-emitting elements 135 may be provided at the centre of the PoV display unit 100 to provide a more complete PoV effect.

In this example, the PoV display unit 100 comprises a rotatory PoV display unit. In other words, in this example, the PoV display unit 100 provides a PoV effect by causing the arms 110, 115, 120, 125 to rotate about the main body 105. The speed of rotation may depend on the number of arms 110, 115, 120, 125 of the PoV display unit 100. For example, a PoV display unit 100 having relatively few arms may have a higher speed of rotation than a PoV display unit 100 having relatively many arms. However, the PoV display unit 100 may be configured differently. For example, the PoV display unit 100 may comprise a linear PoV display unit in which one or more arms are configured to perform a sweeping movement to provide a PoV effect. Such sweeping movement may be side-to-side, up-and-down etc.

In this example, the arms 110, 115, 120, 125 are, collectively, rotatably coupled to the main body 105. As such, in use, the arms 110, 115, 120, 125 may be driven, for example by a motor in the main body 105, to rotate about the main body 105. In this example, the arms 110, 115, 120, 125 are arranged to rotate in unison (or "together") about the main body 105. The arms 110, 115 may be able to rotate in a clockwise direction only, in an anticlockwise (or 'counter-clockwise') direction only, or may be able to rotate in both the clockwise and anticlockwise and anticlockwise directions at different times.

The reader is referred to PCT patent application no. PCT/GB2015/050843 (International publication no. WO 2015/140578) which relates to a PoV display apparatus which may have the same or similar features to the example display unit 100 described herein, and the entire content of which is incorporated herein by reference.

Figure 3:
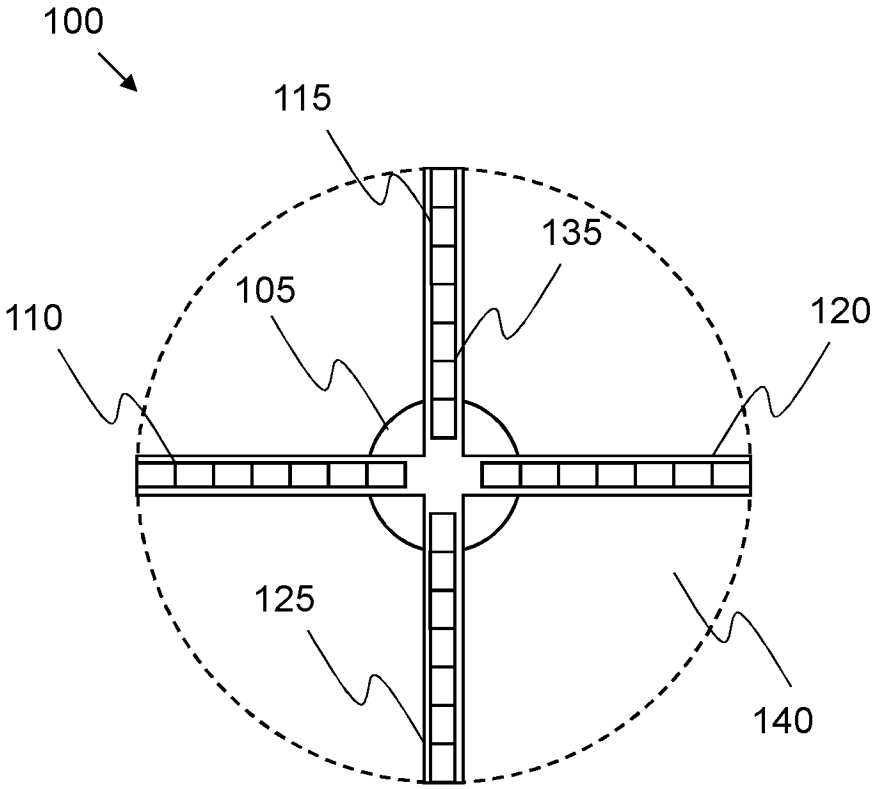
FIG. 3 shows another schematic representation the example PoV display device shown in FIG. 1 from the front of the PoV display device.

Referring to FIG. 3, there is shown schematically a front view of the example PoV display unit 100 shown in FIG. 1, the PoV display unit 100 having a display area 140.

The display area 140 corresponds to the area in which the PoV display unit 100 provides the PoV effect.

In this example, the display area 140 is circular. However, the display area 140 may be a different shape. For example, in examples in which the PoV display unit 100 has one or more sweeping arms, the display area 140 may be rectangular.

Figure 4:
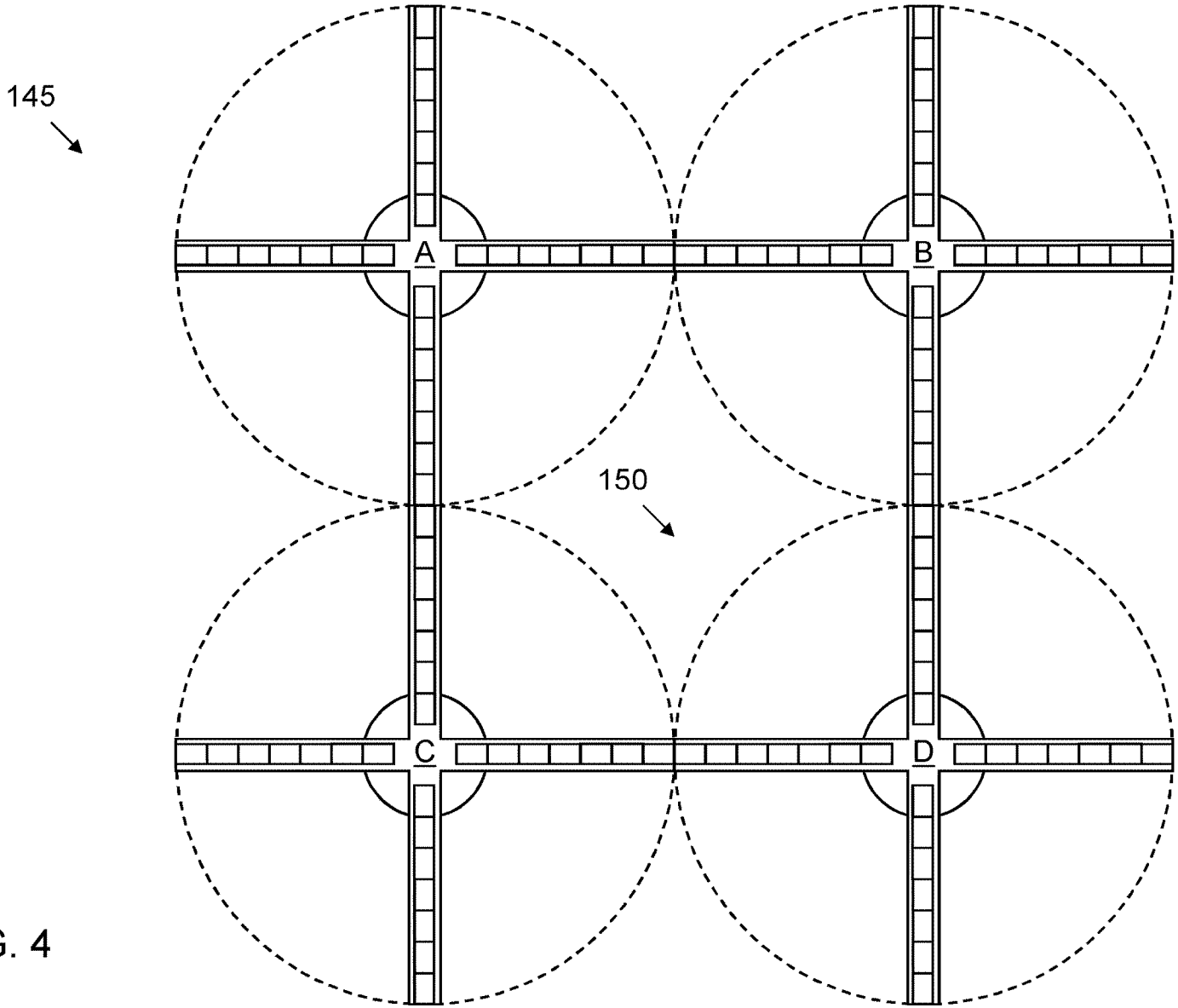
FIG. 4 shows a schematic representation an example of a set of PoV display devices from the front of the set of PoV display devices.
Figure 5:
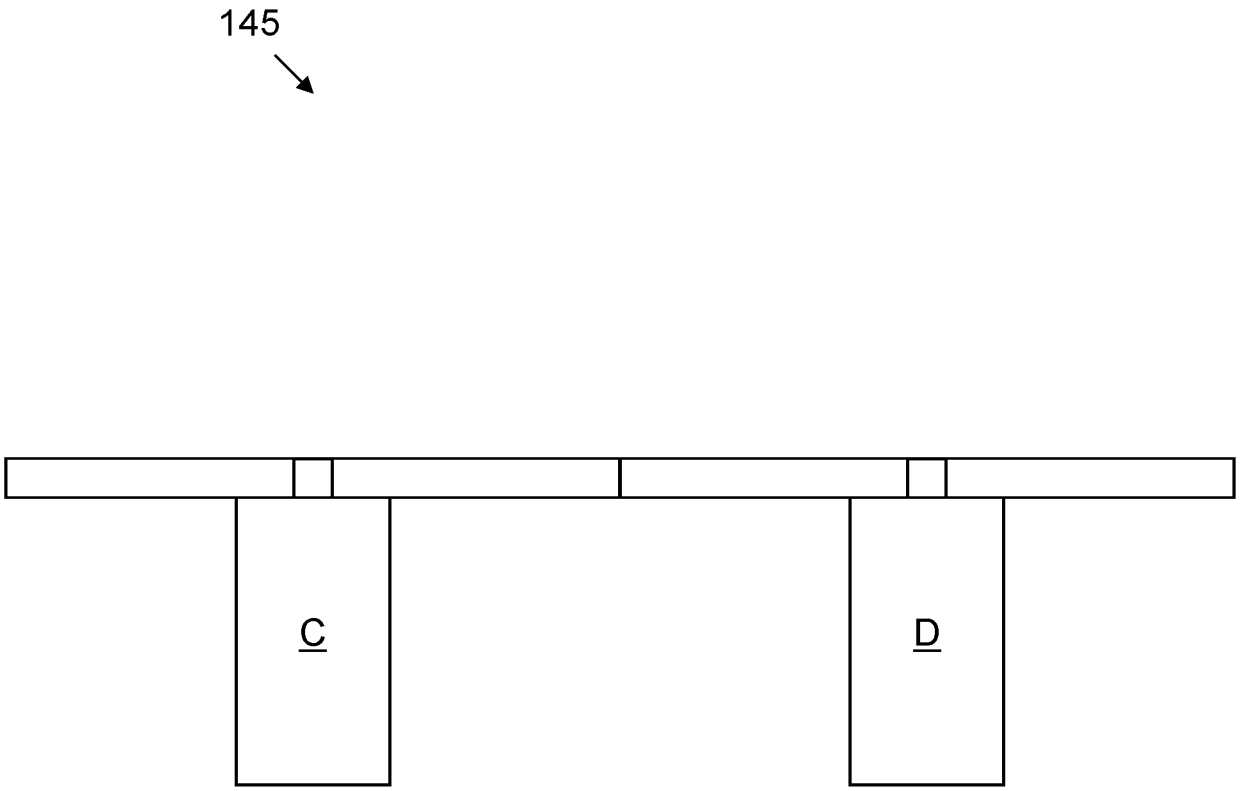
FIG. 5 shows a schematic representation of the example set of PoV display devices shown in FIG. 4 from underneath the set of PoV display devices.

Referring to FIGS. 4 and 5, there are shown schematically front and underneath views respectively of an example set of PoV display units 145.

Each of the PoV display units shown in FIGS. 4 and 5 corresponds to the example display unit 100 described above with reference to FIGS. 1 to 3.

In this example, the set of PoV display units 145 consists of four PoV display units, with the letters "A", "B", "C" and "D" being used to indicate the first through fourth display units respectively in FIGS. 4 and 5.

In this example, the PoV display units are arranged such that their respective display areas form a 2×2 array.

In this example, the PoV display units are arranged such that the 2×2 array is in at least one display plane.

As may best be seen in FIG. 5, in this example, the at least one display plane consists of only a single display plane. In other words, in this example, the display areas are all comprised in a single (or "common") display plane. This can be more effective visually and can provide a more compact arrangement than where the display areas are comprised in multiple display planes.

In this example, the PoV display units are arranged such that their respective display areas form a display area void 150. The display area void 150 is bounded by the display areas. The display area void 150 is formed because none of the light-emitting elements of the PoV display units passes through the display area void 150 as the PoV display units rotate. In this example, no PoV effect is provided in the display area void 150.

In this example, the boundary of the display area void 150 corresponds to four equally-sized concave sections, where each concave section corresponds to a quarter-circular arc.

In this example, the PoV display units are arranged such that their respective display areas are non-overlapping. As such, in this example, as the PoV display units rotate, their respective arms do not collide with each other. Furthermore, the overall (or "combined") display area associated with the PoV display units may be relatively large compared to an arrangement in which at least some of the display areas are mutually overlapping, as will be described in more detail below.

Figure 6:
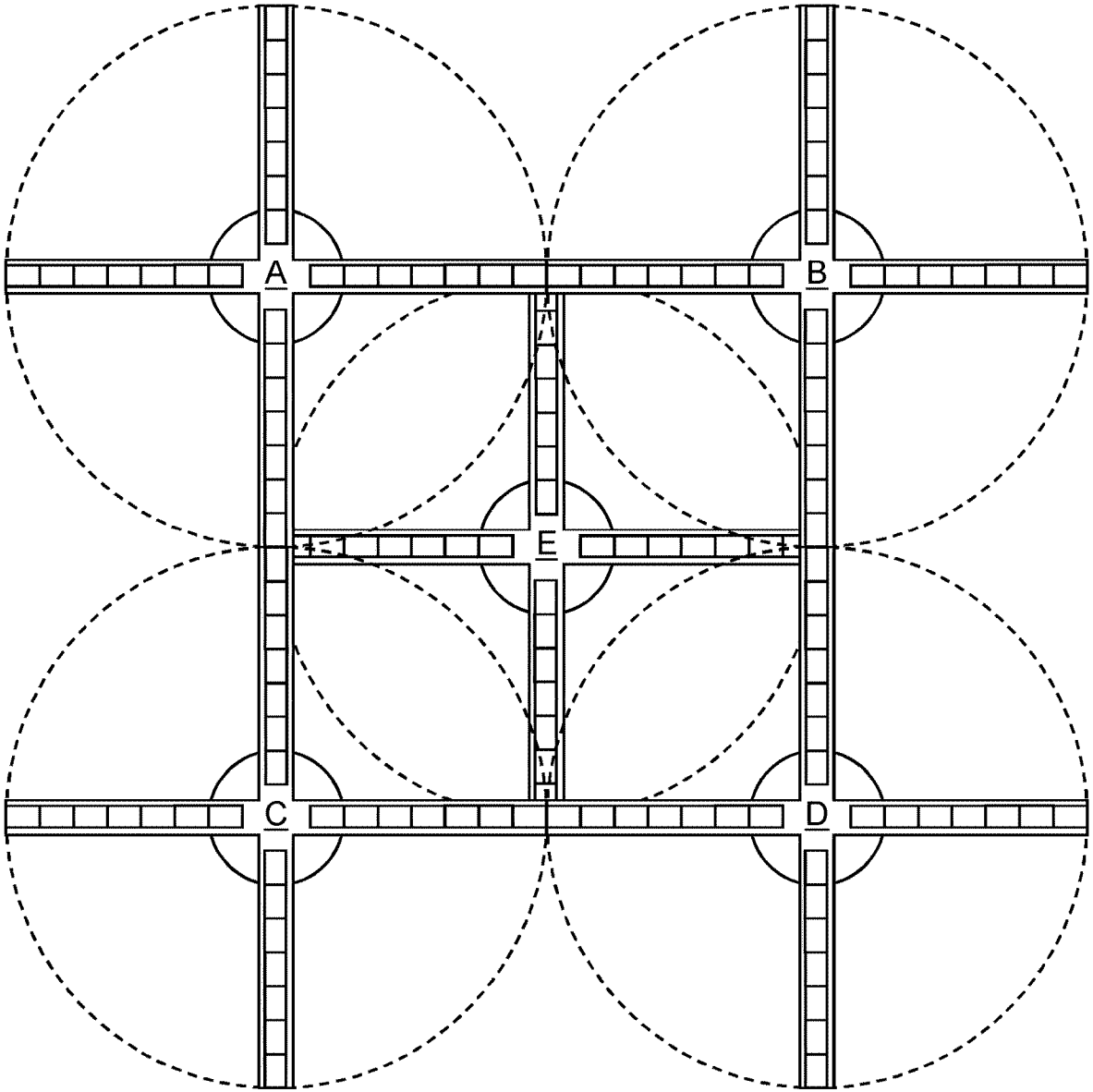
FIG. 6 shows a schematic representation of an example of a PoV display panel in accordance with embodiments of the present invention from the front of the PoV display panel.
Figure 7:
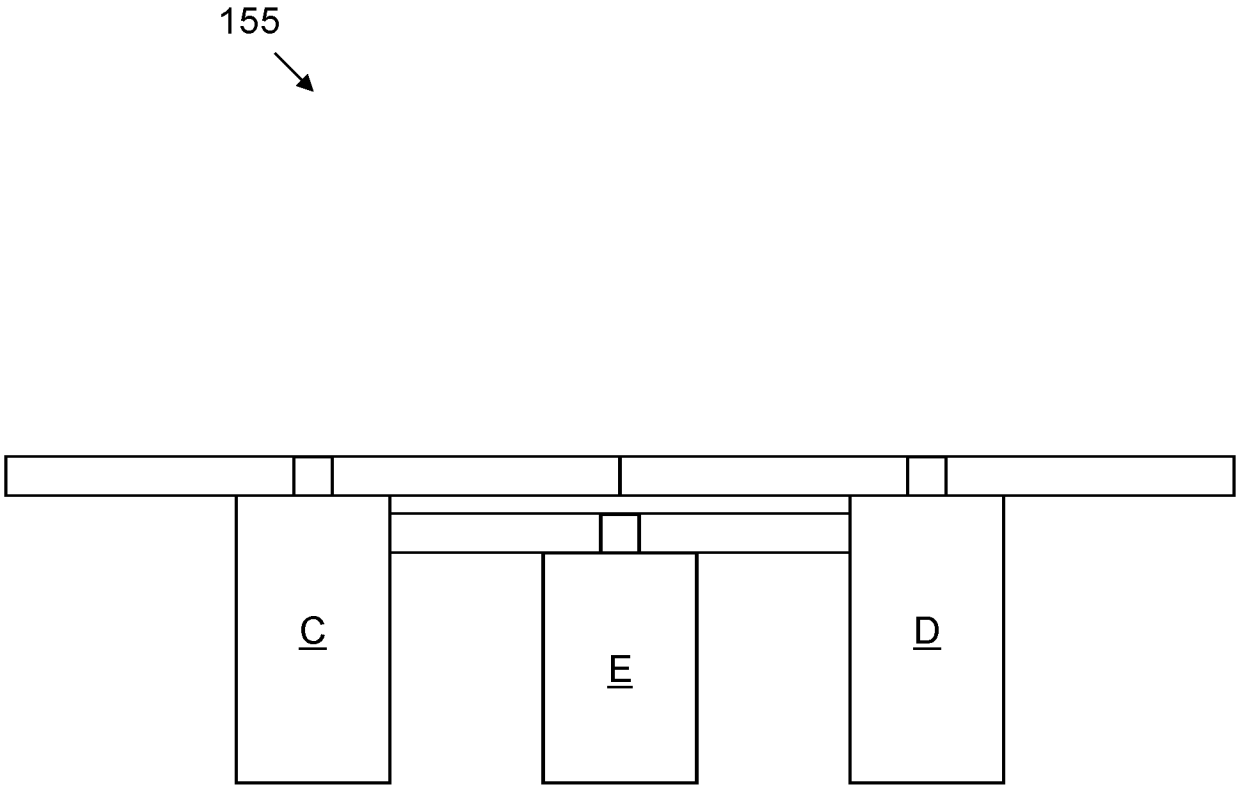
FIG. 7 shows a schematic representation of the example PoV display panel shown in FIG. 6 from underneath the PoV display panel.

Referring to FIGS. 6 and 7, there are shown schematically front and underneath views respectively of an example PoV display panel 155.

Each of the PoV display units shown in FIGS. 6 and 7 corresponds to the example display unit 100 described above with reference to FIGS. 1 to 3.

In this example, the set of PoV display panel 155 consists of five PoV display units, with the letters "A", "B", "C", "D" and "E" being used to indicate the first through fourth display units respectively in FIGS. 6 and 7.

The first through fifth PoV display units have first through fifth display areas respectively.

The fifth PoV display unit is arranged such that the fifth display area is offset from the at least one display plane in which the first through fourth display areas are arranged. In this example, in which the first through fourth display areas are arranged in a single display plane, the fifth PoV display unit is therefore arranged such that the fifth display area is offset from the single display plane in which the first through fourth display areas are arranged. This may facilitate collision mitigation in relation to the fifth PoV display unit.

In this example, the fifth display area being offset from the least one display plane comprises the fifth display area being behind the at least one display plane. In this example, at least part of the fifth display area is visible through the display area void. In other examples, the fifth display area being offset from the least one display plane comprises the fifth display area being in front of the at least one display plane.

The fifth display area being behind the at least one display plane may enable the PoV display panel 155 to be more robust mechanically than if the fifth display area were in front of the at least one display plane. This is because, to provide the fifth display area in front of the at least one display plane, the main body of the fifth PoV display unit may be provided behind the at least one display plane and the one or more arms of the fifth PoV display unit may be provided in front of the at least one display plane. This may involve extending a relatively long shaft through the display area void which may be relatively mechanically unstable, compared to use of a relatively short shaft where the one or more arms of the fifth PoV display unit are provided behind the at least one display plane.

In examples in which the PoV display units are arranged such that their respective display areas form a 2×2 array in a plurality of display planes, the fifth display area being offset from the plurality of display planes may comprise the fifth display area being in front of, between, or behind the plurality of display planes.

The fifth PoV display unit is also arranged such that the fifth display area corresponds to the display area void. The fifth display area corresponding to the display area void may comprise the fifth display area providing a PoV effect to a viewer in the display area void.

As may be seen from FIG. 6, the fifth PoV display unit is arranged such that the arms of the fifth PoV display unit do not collide with the main body of any of the first through fourth PoV display units as the arms of the fifth PoV display unit rotate.

In this example, a centre of the fifth display area is in alignment with a centre of the display area void. This may reduce the risk of collision by having an even spacing between the fifth PoV display unit and the main bodies of the first through fourth PoV displays. In other examples, the centre of the fifth display area may be in alignment with a centre of the display area void.

In this example, the five display areas are the same size as each other. This may facilitate manufacture of the display panel 155 since only one size of PoV display unit may be manufactured to provide the display panel 155. This may also facilitate assembly and/or installation of the display panel 155 as any one of a similar set of PoV display units may be used interchangeably in place of any of the others.

In other examples, some or all of the five display areas are of different sizes to each other. For example, the first through fourth display areas may all be the same size as each other and the fifth display area may be of a different size. In such an example, the fifth PoV display unit may be selected such that the fifth display area is at least the size of the display area void. As such, when viewed from the front, the display panel 155 may appear to a viewer to provide a gapless display area. The display area provided by the PoV display panel 155 may be considered to be gapless in the sense that, from the perspective of viewer, there is a continuous display area within the outer boundary of the PoV display panel 155. There may, in reality, be one or more small display area voids in the display area, but the viewer would nonetheless perceive the display area void to be gapless. For example, any such display area voids may not be noticeable to the viewer even if they are present.

Figure 8:
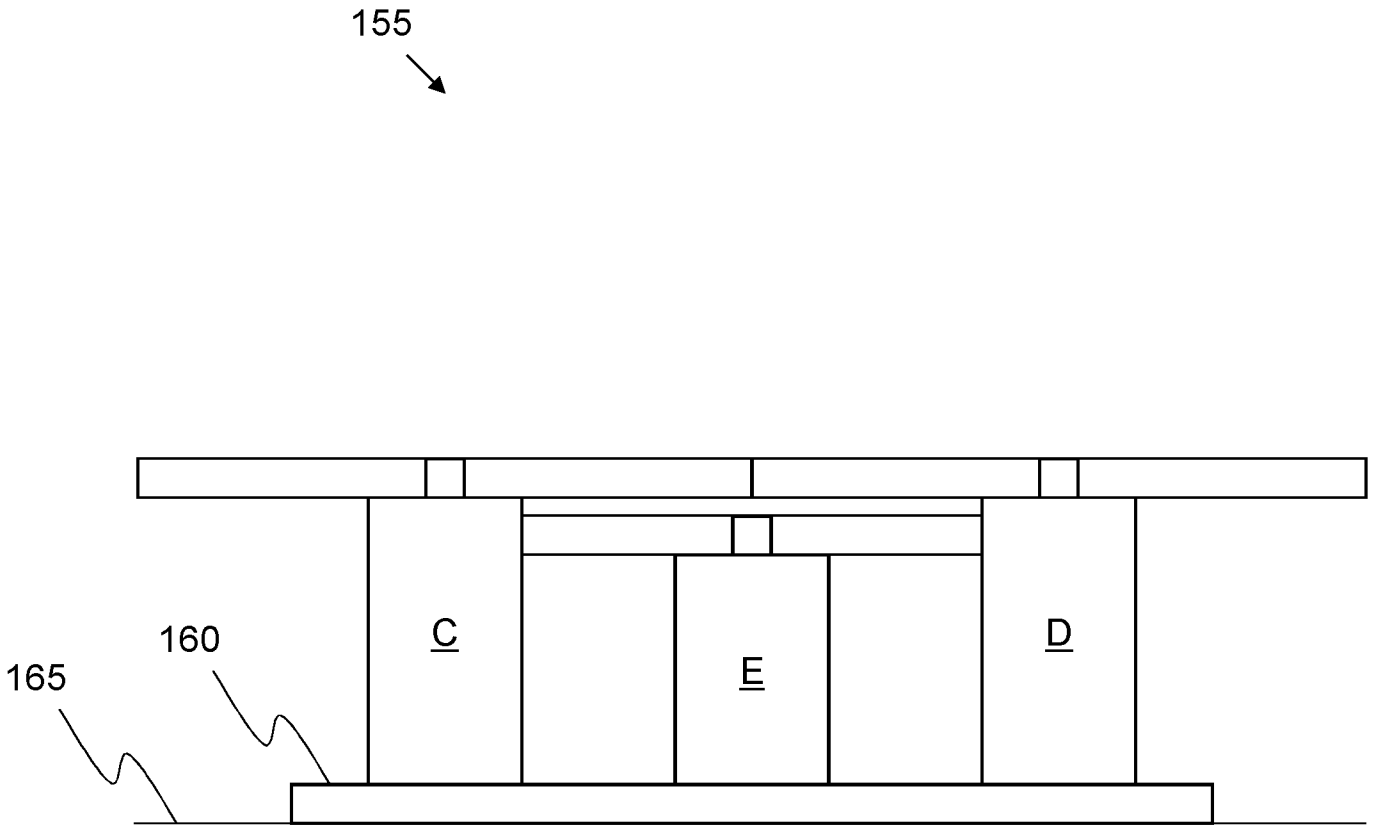
FIG. 8 shows a schematic representation of another example of a PoV display panel in accordance with embodiments of the present invention from the front of the PoV display panel.

Referring to FIG. 8, there is shown schematically an underneath view of another example display panel 155.

The display panel 155 shown in FIG. 8 has several features in common with the display panel 155 described above with reference to FIGS. 6 and 7.

In this example, however, the PoV display panel 155 further comprises a frame 160. In this example, five PoV display units are mounted on the frame 160. The frame 160 may be transparent. A transparent frame 160 may preserve a PoV effect compared to a non-transparent frame. This is because a viewer may not notice a transparent frame, or at least may notice a transparent frame less than a non-transparent frame.

The frame 160 may be mounted on a surface 165. The surface 165 may comprise a floor, a wall and/or a ceiling. As such, the PoV display panel 155 may be conveniently mounted to provide an effective PoV effect. When so-mounted, content displayed by the PoV display panel 155 may appear to float in the air.

Figure 9:
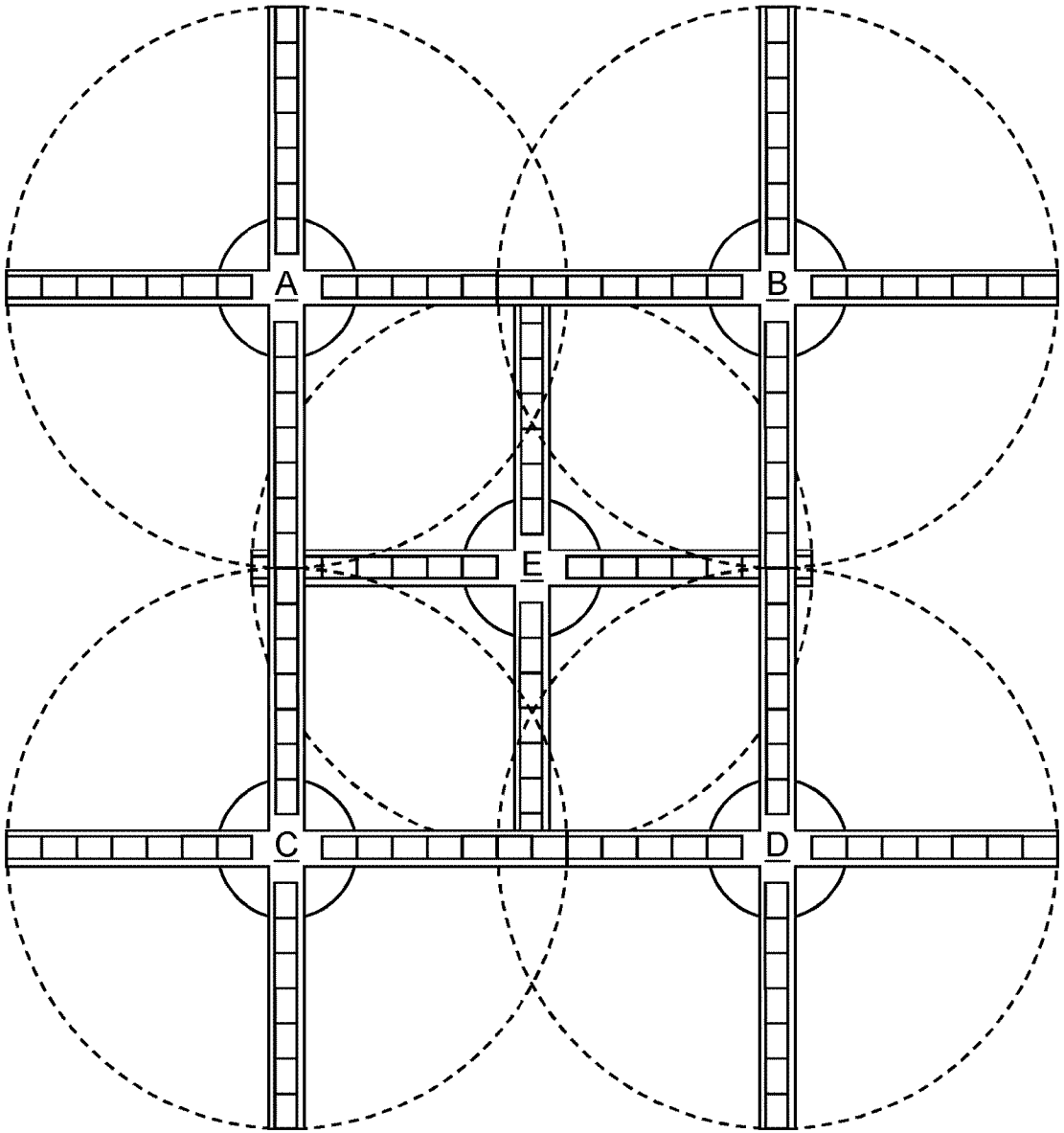
FIG. 9 shows a schematic representation of another example of a PoV display panel in accordance with embodiments of the present invention from the front of the PoV display panel.
Figure 10:
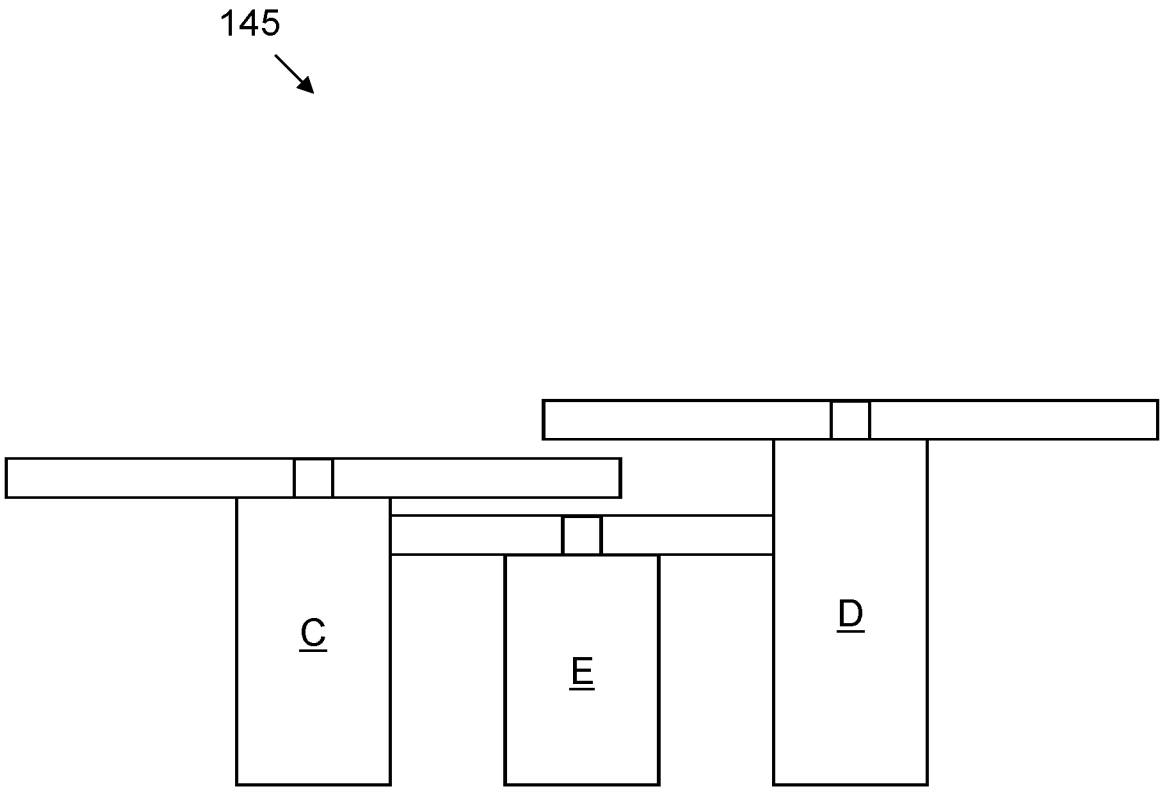
FIG. 10 shows a schematic representation of the example PoV display panel shown in FIG. 9 from underneath the PoV display panel.

Referring to FIGS. 9 and 10, there are shown schematically front and underneath views respectively of another example of a PoV display panel 155.

The display panel 155 shown in FIGS. 9 and 10 has several features in common with the display panel 155 described above with reference to FIGS. 6 and 7.

However, in this example, the first through fourth PoV display units are arranged such that some of their respective display areas are overlapping. In particular, in this example, the first display area overlaps the second display area, and the third display area overlaps the fourth display area. The first and second display areas and the third and fourth display areas are overlapping, in this example, in that the display areas overlap from the perspective of a viewer of the PoV display panel 155.

In this example, the first through fourth PoV display units are arranged such that some of their respective display areas are non-overlapping. In particular, in this example, the first and third display areas are non-overlapping, and the second and fourth display areas are also non-overlapping.

It may be seen from FIG. 9 that, even though there is overlap between both the first display and second display areas and the third and fourth display areas that the fifth PoV display unit is arranged such that the arms of the fifth PoV display unit do not collide with the main body of any of the first through fourth PoV display units as the arms of the fifth PoV display unit rotate.

Figure 11:
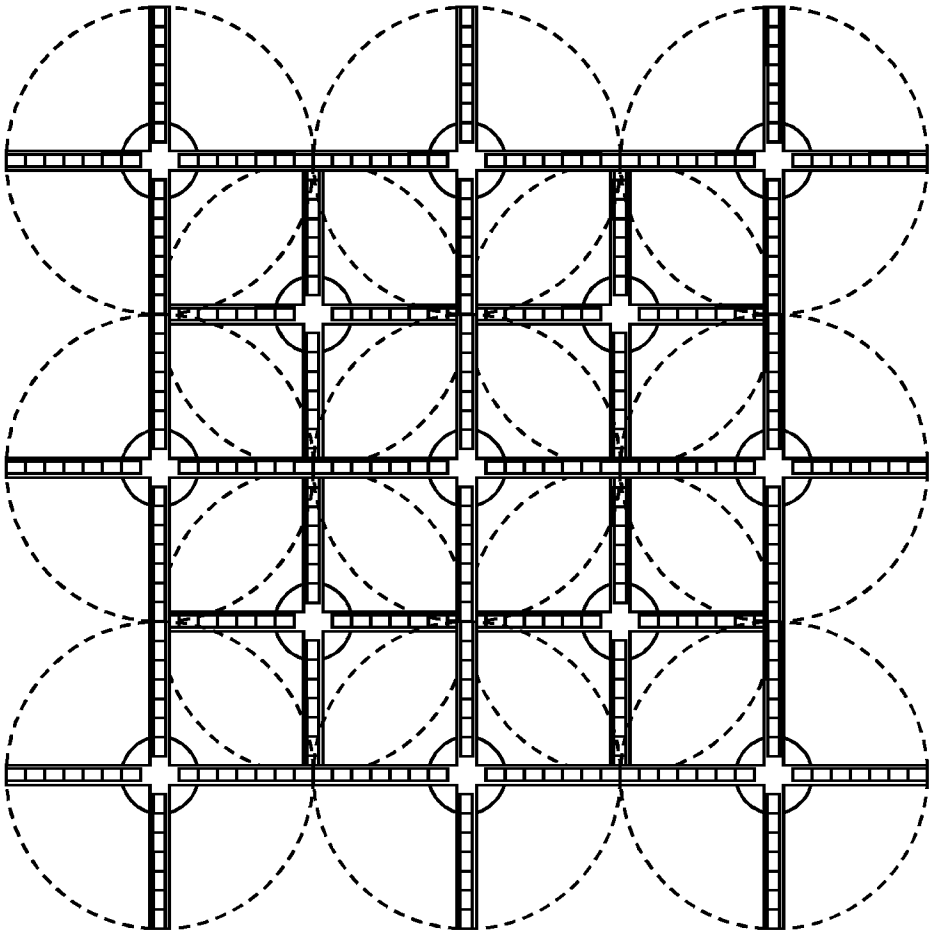
FIG. 11 shows a schematic representation of another example of a PoV display panel in accordance with embodiments of the present invention from the front of the PoV display panel.

Referring to FIG. 11, there is shown schematically a front view of another example of a PoV display panel 155.

In this example, the PoV display panel 155 comprises a plurality of further PoV display units, each having a respective display area. The plurality of further PoV display units is arranged such that the at least one display plane in which the first through fourth display areas are arranged comprises the respective display areas of the plurality of further PoV display units.

In this example, the PoV display panel 155 comprises a plurality of additional PoV display units, each having a respective display area. The plurality of additional PoV display units is arranged such that their respective display areas are offset from the at least one display plane in which the first through fourth display areas and the plurality of further display areas are comprised.

A PoV display panel comprising first, second, third, fourth and fifth PoV display units having first, second, third, fourth and fifth display areas respectively may therefore be provided. The first, second, third and fourth PoV display units are arranged such that their respective display areas form a 2×2 array in at least one display plane and form a display area void bounded by their respective display areas. The fifth PoV display unit is arranged such that the fifth display area is offset from the at least one display plane and corresponds to the display area void. The PoV display panel, which comprises multiple component PoV display units, may be relatively safe and stable while still providing a relatively large display area, compared to use of a large PoV display unit. The relative arrangement of the first through fifth PoV display units provides a relatively large, gapless display area using relatively few PoV display units compared to other possible arrangements of five PoV display units.

The first, second, third, fourth and fifth display areas may be circular. The above-describe arrangement of the first through fifth PoV display units is particularly, but not exclusively, effective where the first through fifth display areas are circular.

The first, second, third, fourth and fifth display areas may be the same size as each other. This can facilitate manufacture, assembly and/or installation of the PoV display panel since like PoV display units may be useable for any of the first through fifth PoV display units.

The first, second, third, fourth and fifth PoV display units may comprise rotatory PoV display units and the first, second, third, fourth and fifth PoV display units are associated with rotation in the same direction as each other. This can facilitate manufacture, assembly and/or installation of the PoV display panel since like PoV display units may be useable for any of the first through fifth PoV display units.

A boundary of the display area void may correspond to four equally-sized concave sections, each concave section corresponding to a quarter-circular arc. The above-describe arrangement of the first through fifth PoV display units enables a PoV effect to be provided in respect of such a display area void.

A centre of the fifth display area may be in alignment with a centre of the display area void. This can facilitate collision mitigation in relation to the fifth PoV display unit.

The fifth display area may be behind the at least one display plane. This may provide a relatively mechanically robust PoV display panel compared, for example, to the fifth display area being in front of the at least one display plane.

The at least one display plane may consist of a single display plane. This may provide a relatively compact PoV display panel and may provide an enhanced visual effect, compared to the at least one display plane consisting of multiple display planes.

The first, second, third and fourth PoV display units may be arranged such that their respective display areas are non-overlapping. This arrangement may provide a relatively large overall display area for the five PoV display units. This arrangement may alternatively or additionally facilitate collision mitigation in relation to the first through fourth PoV display units.

The PoV display panel may comprise a frame. The first, second, third, fourth and fifth PoV display units may be mounted on the frame. The frame may be mounted on a surface. As such, measures are provided for mounting the PoV display panel on a surface, with a degree of separation from the surface provided by the frame. When so-mounted, content displayed by the PoV display panel may appear to float in mid-air.

The frame may be transparent. Such a frame enhances the effect of the PoV display panel by not detracting, or at least providing limited visual distraction, from the PoV effect provided by the first through fifth PoV display units.

The surface may comprise a floor, a wall and/or a ceiling. This can facilitate the appearance or illusion that the content displayed by the PoV display panel is floating in mid-air.

The PoV display panel may comprise at least one further PoV display unit having at least one further display area. The at least one further PoV display unit may be arranged such that the at least one display plane comprises the at least one further display area. As such, the overall display area of this display panel may be effectively extended in an efficient manner.

The PoV display panel may comprise at least one additional PoV display unit having at least one additional display area. The at least one additional PoV display unit may be arranged such that the at least one additional display area is offset from the at least one display plane. As such, the overall display area of this display panel may be effectively extended in an efficient manner.

The at least one additional display area and the fifth display area may be in the same display plane as each other. As such, the at least one additional display area may correspond to at least one display area void formed, at least in part, by the at least one further display area.

PoV display system comprising a plurality of such PoV display panels may be provided. As such, the overall display area of this display panel may be effectively extended in an efficient manner.

The above embodiments are to be understood as illustrative examples of the invention. Further embodiments of the invention are envisaged.

In examples described above, a PoV display unit comprises one or more arms which comprise one or more light-emitting elements to provide a PoV effect. In other examples, a PoV display comprises a member other than an arm which comprises one or more light-emitting elements to provide a PoV effect. An example of another such member is a disc. For example, a PoV display unit may comprise a disc that comprises one or more light-emitting elements and which is driveable to rotate so as to produce a PoV effect.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A persistence of vision, PoV, display panel comprising first, second, third, fourth and fifth PoV display units having first, second, third, fourth and fifth display areas respectively, wherein the first, second, third and fourth PoV display units are arranged such that their respective display areas form a 2×2 array in at least one display plane and form a display area void bounded by their respective display areas, and wherein the fifth PoV display unit is arranged such that the fifth display area is offset from the at least one display plane and corresponds to the display area void.

2. A PoV display panel according to claim 1, wherein the first, second, third, fourth and fifth display areas are circular.

3. A PoV display panel according to claim 1, wherein the first, second, third, fourth and fifth display areas are a same size as each other.

4. A PoV display panel according to claim 1, wherein the first, second, third, fourth and fifth PoV display units comprise rotatory PoV display units and wherein the first, second, third, fourth and fifth PoV display units are associated with rotation in a same direction as each other.

5. A PoV display panel according to claim 1, wherein a boundary of the display area void corresponds to four equally-sized concave sections, each concave section corresponding to a quarter-circular arc.

6. A PoV display panel according to claim 1, wherein a centre of the fifth display area is in alignment with a centre of the display area void.

7. A PoV display panel according to claim 1, wherein the fifth display area is behind the at least one display plane.

8. A PoV display panel according to claim 1, wherein the at least one display plane consists of a single display plane.

9. A PoV display panel according to claim 1, wherein the first, second, third and fourth PoV display units are arranged such that their respective display areas are non-overlapping.

10. A PoV display panel according to claim 1, wherein the PoV display panel comprises a frame, wherein the first, second, third, fourth and fifth PoV display units are mounted on the frame, and wherein the frame is mounted on a surface.

11. A PoV display panel according to claim 10, wherein the frame is transparent.

12. A PoV display panel according to claim 10, wherein the surface comprises a floor.

13. A PoV display panel according to claim 10, wherein the surface comprises a wall.

14. A PoV display panel according to claim 10, wherein the surface comprises a ceiling.

15. A PoV display panel according to claim 1, comprising at least one further PoV display unit having at least one further display area, the at least one further PoV display unit being arranged such that the at least one display plane comprises the at least one further display area.

16. A PoV display panel according to claim 1, comprising at least one additional PoV display unit having at least one additional display area, the at least one additional PoV display unit being arranged such that the at least one additional display area is offset from the at least one display plane.

17. A PoV display panel according to claim 16, wherein the at least one additional display area and the fifth display area are in the same display plane as each other.

18. A PoV display system comprising a plurality of PoV display panels according to claim 1.

* * * * *